US005413162A

United States Patent [19]

Ciriaci

[11] Patent Number: 5,413,162

[45] Date of Patent: May 9, 1995

[54] CONTROL UNIT FOR VERTICAL BLIND ASSEMBLY

[75] Inventor: Piergiorgio Ciriaci, Hollywood, Fla.

[73] Assignee: Micro Molds Corp., Hialeah, Fla.

[21] Appl. No.: 106,708

[22] Filed: Aug. 16, 1993

[51] Int. Cl.[6] ..... E06B 9/38

[52] U.S. Cl. ..... 160/177

[58] Field of Search ..... 160/177 R, 177 V, 176.1 R, 160/176.1 V, 168.1 V, 172 V, 166.1 R, 173 V, 170 R, 171 R, 174 V

[56] References Cited

U.S. PATENT DOCUMENTS

| | | | |
|---|---|---|---|
| 3,789,905 | 2/1974 | Saito | 160/176.1 V X |
| 4,224,973 | 9/1980 | Hugin | 160/176.1 V X |
| 4,657,060 | 4/1987 | Kaucic | 160/176.1 V X |
| 4,732,202 | 3/1988 | Anderson | 160/177 V X |
| 4,834,163 | 5/1989 | Dickstein | 160/177 V X |
| 4,836,345 | 6/1989 | Anderson | 160/176.1 V X |
| 4,848,435 | 7/1989 | Helver | 160/176.1 V X |
| 4,936,370 | 6/1990 | Uecker et al. | 160/176.1 V X |
| 5,054,535 | 10/1991 | Rozon | 160/176.1 V X |

*Primary Examiner*—David M. Purol
*Attorney, Agent, or Firm*—Robert M. Downey

[57] ABSTRACT

A control unit for use on a vertical blind assembly of the type designed to movably support individual vertically oriented vanes from a horizontally oriented track structure; the control unit being structured and disposed to controllably rotate a pinion rod extending along a length of the track structure for driving engagement with, and synchronized angular adjustment of the vanes. The control unit includes a control housing and is adapted to rotatably support the pinion rod within the track structure. The drive gear assembly within the control housing is drivingly connected to one end of the pinion rod and includes a sprocket gear movably driven by a pull chain selectively in either of two opposite directions. The drive gear assembly is structured to achieve a reduction in rotation between the sprocket gear and pinion rod, thereby providing for increased controlled adjustment of the angular orientation of the vanes. The drive gear assembly is further structured to prevent forced rotation of the pinion rod in response to a rotational force applied to the pinion rod externally of the drive gear assembly, thereby preventing inadvertent displacement of the vanes from an adjusted angular orientation.

15 Claims, 3 Drawing Sheets

CONTROL UNIT FOR VERTICAL BLIND ASSEMBLY

BACKGROUND OF THE INVENTION

I. Field of the Invention

The present invention relates to vertical blind assemblies of the type including a horizontally disposed track structure for supporting vertically oriented vanes or blind panels and having an elongate pinion rod rotatably mounted therein. More particularly, the present invention relates to a control unit for controlled rotation of the pinion rod in a vertical blind assembly.

II. Description of the Related Art

Vertical blind assemblies of various types are well known in the art and are available to the consuming public from a number of manufacturers. Most vertical blind assemblies include vertically disposed vanes or panels which are supported from a track structure and capable of being selectively moved along a length of the track structure. Additionally, these assemblies provide for synchronized angular adjustment of the vanes collectively into a common angular orientation about their respective longitudinal axis. In many vertical blind assemblies, the angular adjustment of the vanes is achieved by a pinion rod which engages a gear structure on a carrier assembly attached to each vane. Upon rotation of the pinion rod, each of the vanes are simultaneously turned in synchronized fashion to a common angular orientation. The individual carrier assemblies, each supporting an individual vane, are positionable along the length of the track structure or selectively they may be retracted into a closely bunched adjacent position near one end of the track structure.

The elongate pinion rods used in these type of vertical blind assemblies are manufactured in various sizes and are generally classified in the field based on the number of elongate ridges they have about their outer surface, such as 8 prong or 3 prong. An 8 prong pinion rod would have 8 generally parallel ridges running along its length, forming a groove or trough between adjacent ridges. The ridges and grooves act as gear teeth engaging the associated gear structure attached to the top of each of the individual vanes along the length of the pinion rod.

When the pinion rods are manufactured, there is inevitably a degree of error resulting in a slight twist being introduced to the rod. This twist causes the ridges to spiral very slightly between opposite ends of the pinion rod. The twist in the rod results in the failure of all vanes to fully turn through a complete range of movement between an open position and a closed position, especially with longer track structures having a long pinion rod and a large number of vanes there-along. In an attempt to overcome this problem, many users of vertical blind assemblies apply an increased amount of torque to the pinion rod by pulling harder on the control mechanism pull chain. This causes the pinion rod to first coil and upon release of the pull chain, to recoil or back-off resulting in unwanted reverse turning of the vanes. This is especially noticed when closing the vanes so that their edges overlap with one another. Once fully closed, upon releasing the pull chain a number of the vanes towards one end of the assembly may be caused to move in a reverse direction, resulting in the separation of the overlapping edges and leaving a gap between adjacent vanes.

Another problem associated with the vertical blind assemblies in the related art is the undesireable movement of the vanes caused by externally applied forces, such as wind. Often a strong breeze will cause the vanes to turn if a window or sliding doors adjacent to the vanes are left open. Additionally, if one or more vanes are forced to turn, such as by a person passing through the blinds of a doorway, all of the vanes along the length of the assembly will be turned from their adjusted set position. This has been found to be a nuisance to many people who must constantly re-adjust their vertical blinds whenever there is a strong breeze or when someone passing through the blinds disturbs any of the vanes.

Accordingly, in view of the above-mentioned problems associated with the vertical blind assemblies in the prior art, there is a need for a vertical blind control mechanism which will allow for fine tuned, synchronized adjustment of the vanes and which will further prevent recoiling or unwanted movement of the vanes caused by forces other than that applied by the control mechanism.

It is, therefor, a primary object of the present invention to provide a control unit for use in rotating the pinion rod of a vertical blind assembly and having means to prevent the pinion rod from rotating due to torque or other forces applied externally of the control unit. Specifically, it is a primary object of the present invention to provide a control unit which includes means to prevent unwanted turning of the vanes due to a recoil of the pinion rod or by an externally applied force to any of the vanes or the pinion rod.

It is another object of the present invention to provide a control unit for use with a vertical blind assembly having means to enable fine tuned synchronized adjustment of the associated vanes.

It is yet a further object of the present invention to provide a control unit for rotating the pinion rod in a vertical blind assembly and which includes reduction gear means adapted to provide a decrease speed of rotation of the pinion rod, thereby providing increased control of adjustment of the vanes.

It is still a further object of the present invention to provide a control unit for rotating the pinion rod in a vertical blind assembly which is structured to apply increased torque when turning the pinion rod, thereby providing for ease of operation.

It is still a further object of the present invention to provide a control unit for a vertical blind assembly having a housing specifically structured to fit within the end of a standard track structure and which will accomodate the vertical passage of a pull cord therethrough, eliminating the need to notch or otherwise modify the track structure of the assembly.

These and other objects and advantages of the present invention will be more readily apparent in the description which follows.

SUMMARY OF THE INVENTION

The present invention is directed to a control unit for use with a vertical blind assembly, and more particularly, a control unit for enabling controlled rotation of a pinion rod supported within the track structure of the assembly.

The control unit includes a control housing specifically sized and configured to fit within one end of a standard track structure of a vertical blind assembly. The control housing includes means to rotatably secure one end of the pinion rod extending along the length of the track structure. An end housing attached at an opposite end of the track structure includes means to rotatably support the opposite end of the pinion rod. Together, the control housing and end housing serve to support and rotatably interconnect the opposite ends of the pinion rod in supported position within the track structure of the vertical blind assembly.

The control unit further includes a drive gear assembly comprising a plurality of intermeshing gears structured and disposed to drivingly rotate the pinion rod at a controlled, reduced rate of rotation while increasing the amount of torque applied to the pinion rod for rotation thereof. The drive gear assembly includes a sprocket gear movably driven by a pull chain, selectively in either of two opposite directions, so as to effectively rotate the pinion rod in a desired direction to open or close the vanes. The sprocket gear has a first outer gear face defining a sprocket adapted for driving engagement with a bead chain. An opposite inner gear face on the sprocket gear intermeshes with a pair of first spur gears rotatably mounted within the control housing.

An important feature of the present invention is a worm gear which includes a pair of second spur gears integrally formed at opposite ends thereof and which are disposed in driven engagement with respective ones of the first pair of spur gears. The worm gear includes a spiral gear ridge about its outer surface, a portion of which rides within grooves formed between elongate gear teeth on a helical gear. The gear teeth on the helical gear are slightly canted or angled relative to a central longitudinal axis, such that the gear ridge on the worm gear engages one side of the helical gear teeth when rotating, thus forcing the helical gear to rotate in either of two directions depending on the direction of rotation of the worm gear. The helical gear includes a hollow core structured and congruently configured for fitted receipt of one end of the pinion rod therein. In this manner, the pinion rod is rotated upon rotation of the helical gear.

Accordingly, driven rotation of the sprocket gear by the pull chain drives the spur gears, worm gear and helical gear resulting in rotation of the pinion rod. A reduction in the speed of rotation is accomplished between the sprocket gear and helical gear, thereby providing greater control over the angular movement of the vanes driven by the pinion rod. Attempted forced rotation of the helical gear against the worm gear results in the helical gear teeth being jammed against the gear ridge of the worm gear. Thus, while the worm gear is structured and disposed to effectively drive the helical gear, the helical gear cannot drive the worm gear in a reverse manner. This prevents the pinion rod from being rotated by forces other than the rotational force applied by the drive means of the control unit. Accordingly, undesireable angular movement of the vanes is eliminated.

The present invention is more fully described in the detailed description which follows and the scope of the invention is set forth in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
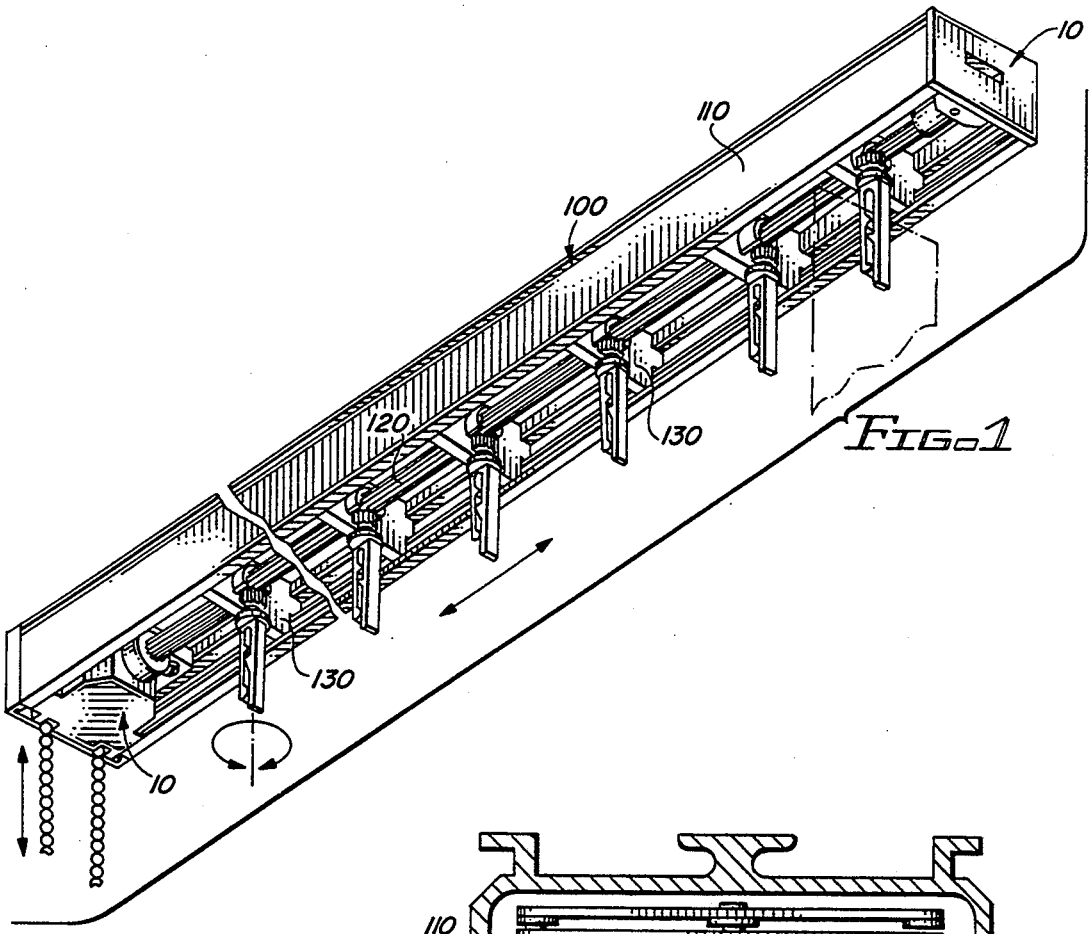
FIG. 1 is a bottom perspective view of a vertical blind assembly of the type including a track structure and elongate pinion rod rotatably mounted within the housing, the assembly including the control unit of the present invention for rotating the pinion rod.
Figures 2, 3, 6, 7, 8:
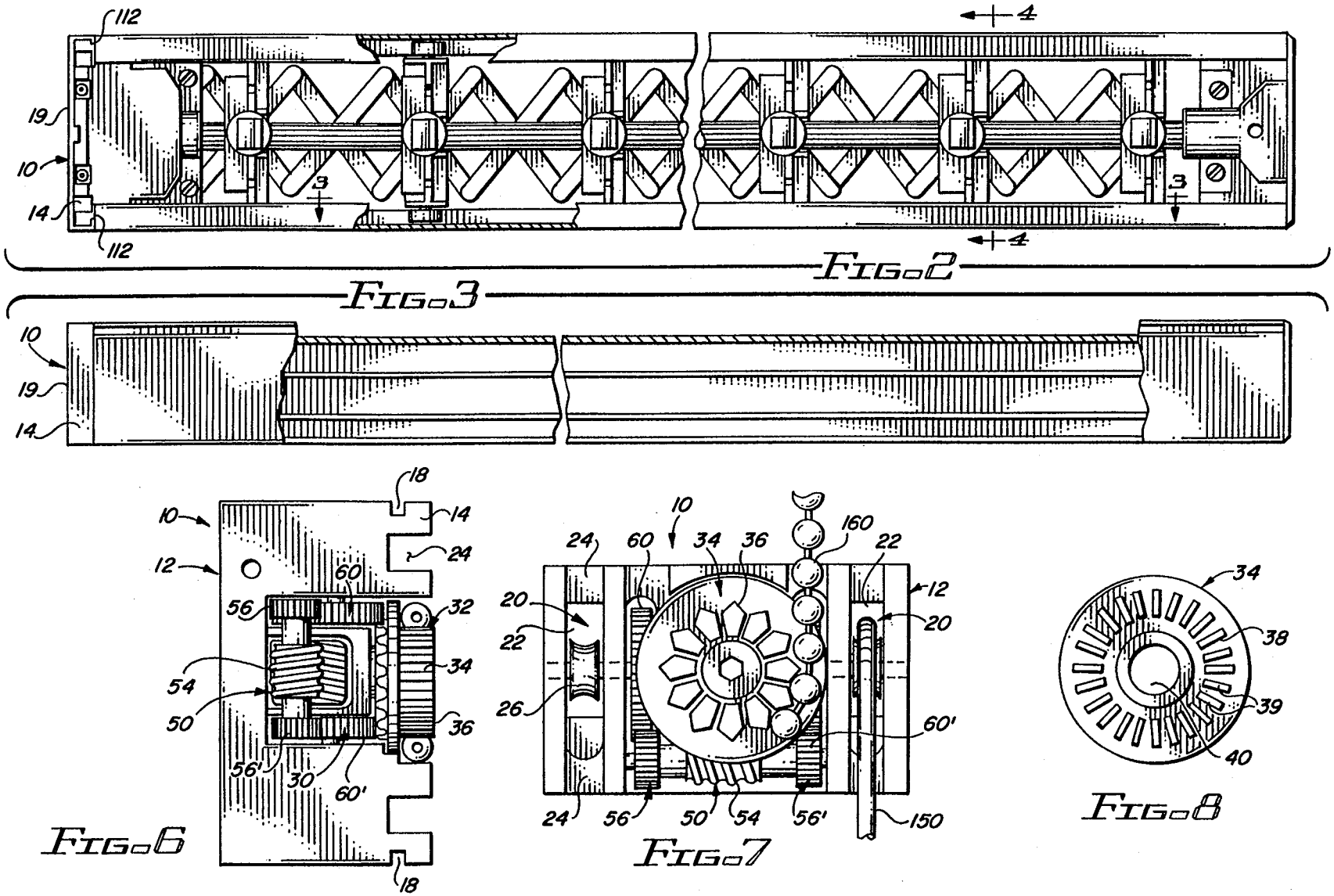
FIG. 2 is a bottom plan view of the vertical blind assembly of FIG. 1, including the control unit of the present invention.
FIG. 3 is a front view, shown in partial cutaway, of a track structure used in connection with the control unit of the present invention.
FIG. 6 is a top plan view of the control unit of the present invention.
FIG. 7 is an inverted end plan view of the control unit.
FIG. 8 is a rear view of a sprocket gear in the control unit, illustrating an inner gear face thereof.
Figure 9:
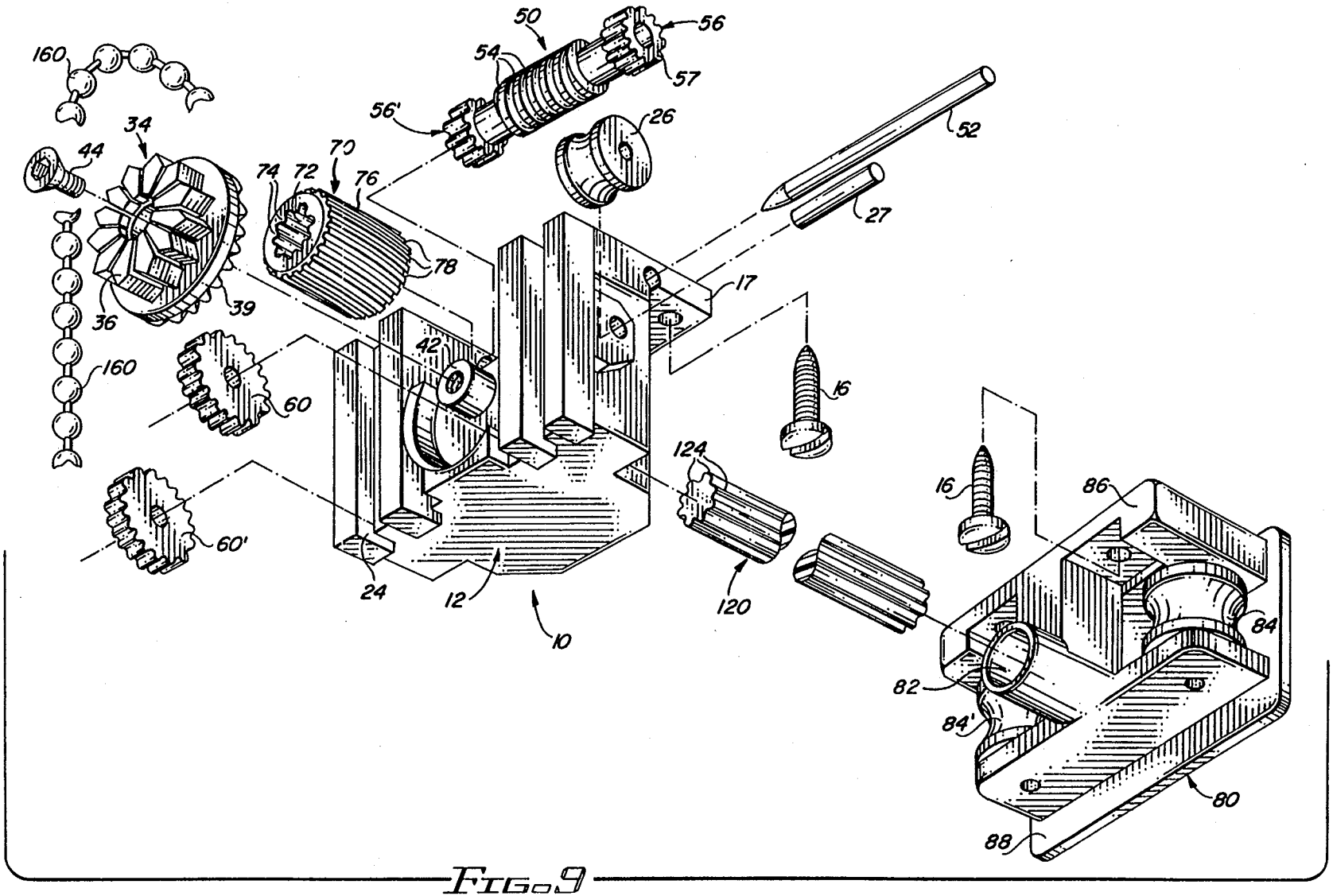
FIG. 9 is an exploded view shown in perspective, illustrating the component parts of the control unit, including the control housing and drive assembly therein, an end housing and the pinion rod.

Referring initially to FIGS. 1 and 2, the present invention is directed to a control unit, generally indicated as 10, for use on a vertical blind assembly 100 of the type including a track structure 110 of sufficient length to extend the length of a window, doorway, passageway, etc. The vertical blind assembly 100 of the type used with the control unit 10 of the present invention further includes a pinion rod 120 which is ratably supported within and extends the length of the track structure 110. A plurality of carrier assemblies 130 are supported in the track structure 110 and are allowed to travel along the length thereof. Each of the carrier assemblies 130 are structured and disposed for attachment with a corresponding one of a plurality of vertically oriented vanes or blind panels (not shown) which hang from the carrier assemblies. Selective movement of the carrier assemblies along the track structure 110 causes the vertically oriented vanes to be selectively disbursed in equally spaced relation along the length of the track structure 110 or, alternatively, drawn together in closely adjacent, bunched relation. The carrier assemblies 130 are further structured to be in driven engagement with the pinion rod 120 to facilitate synchronized, angular movement of the vanes upon driven rotation of the pinion rod by the control unit 10.

Figure 4:
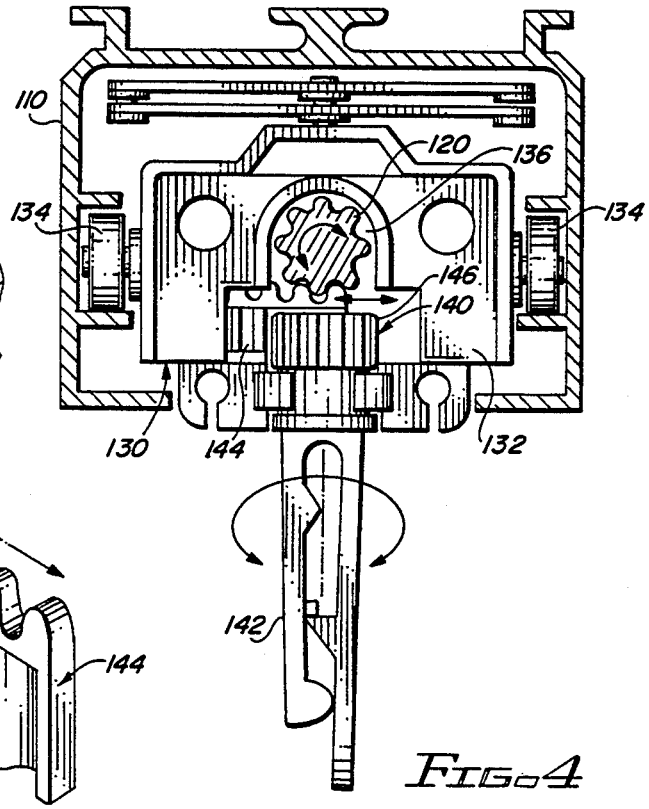
FIG. 4 is a sectional view along line 4—4 of FIG. 2 showing structural details of a carrier assembly and associated gear structure driven by a pinion rod of the vertical blind assembly.
Figure 5:
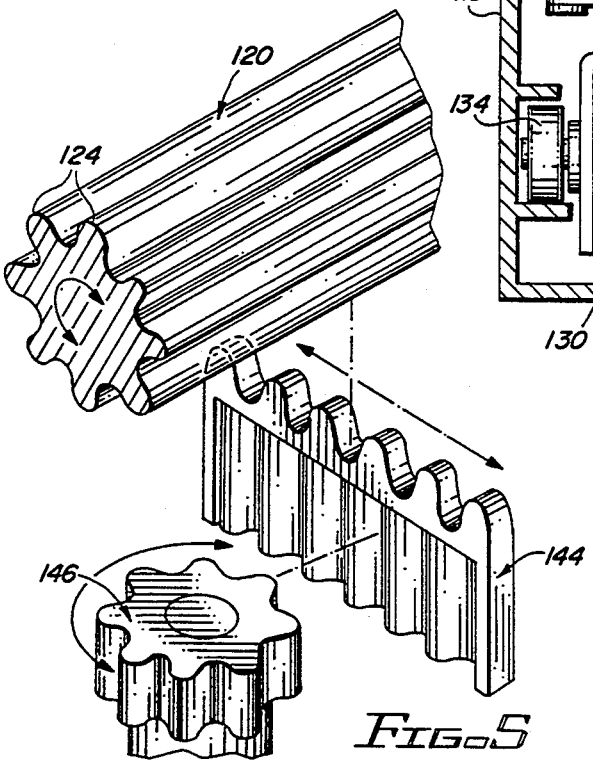
FIG. 5 is an isolated view shown in perspective, of the associated gear structure and pinion rod used in the vertical blind assembly to turn an individual vane or blind panel.

As shown in FIGS. 4 and 5, each of the carrier assemblies 130 include a support frame 132 having rollers 134 rotatably attached thereto to permit movement of the carrier assemblies 130 along the track structure 110. The pinion rod passes through a central aperture 136 in the support frame 132 of each carrier assembly 130 and engages a gear assembly 140 to drivingly rotate or turn a stem 142 which holds a corresponding vane (not shown). The gear assembly 140 is clearly seen in FIG. 5 and may include a rack type gear 144 which engages between elongate ridges 124 on the pinion rod. The rack gear 144 further engages a gear element 146 on the stem 142. As the pinion rod 120 is selectively rotated in either of two opposite directions by the control unit 110 of the present invention, the rack gear is moved, turning the gear element 146 and attached stem 142.

Focusing more closely now on the present invention, FIGS. 6 through 9 illustrate the structural elements of the control unit 10 which rotatably supports and drivingly rotates the pinion rod 120 within track structure 110 to accomplish the selective and controlled, synchronized angular movement of the vane. The control unit 10 includes a housing 12 specifically sized and configured for sliding receipt within an open end 112 of the track structure 110 such that an outer end portion 14 of the housing 12 protrudes slightly from the end 112 of the track 110 (see FIGS. 2 and 3). Once inserted into the track structure 110, the control housing 12 is secured thereto by conventional screw fasteners 16 which pass through apertures in a flanged portion 17 of the housing 12, applying pressure to an inner surface of the track structure (see FIG. 9). The housing 12 is further provided with grooves 18 on opposite sides for sliding receipt of flanged edges of a housing cover 19 which covers the outer end portion 14, as best seen in FIG. 2. Extending through the housing 12 on opposite sides are pull cord channels 20 for passage of a pull cord 150 therethrough. The channels 20 each include a horizontal portion 22 and a vertically oriented slot 24. The vertical slots 24 are formed in the outer end portion 14 of the housing 12 so as to permit uninterrupted passage of the pull cord 150, without interference with the track structure 110. A guide pulley 26 is rotatably mounted by a pin 27 within each of the channels 20 at a junction of the horizontal portion 22 and vertical slot 24 so as to effectively direct and permit free movement of the pull cord 150 therethrough.

The control housing 12 further includes a drive gear chamber 30 for housing a drive gear assembly 32 of the control unit 10 therein. The drive gear assembly 32 includes a sprocket gear 34 having an outer gear face 36 defining a sprocket. The outer gear face 36 is specifically structured for driven engagement with a bead pull chain 160. Sprocket gear 34 is movably driven by pull chain 160, selectively in either of two opposite directions, so as to operate a remainder of the drive gear assembly 32. An opposite inner gear face 38 of the sprocket gear 34 is best seen in FIG. 8 and includes a plurality of gear teeth 39 radiating outwardly from a central aperture 40 extending therethrough. The sprocket gear 34 is rotatably mounted on a protruding hub 42 on the housing 12 by a threaded fastener 44 which extends axially through aperture 40 and threadably engages with an inner threaded surface of the hub 42, permitting the sprocket gear 34 to freely rotate on the hub 42.

The drive gear assembly 32 further includes a worm gear 50 rotatably mounted within the drive gear chamber 30 on an axle 52 fitted within a bore in the housing and extending transversely across the drive gear chamber 30. The worm gear 50 includes a spiral gear ridge 54 about an outer surface thereof and an axial bore for passage of the axle 52 therethrough. A pair of second spur gears 56, 56' are integrally formed on opposite ends of the worm gear 50, so as to rotate with the worm gear about axle 52.

A pair of first spur gears 60, 60' are rotatably mounted to the control housing 12 within the drive gear chamber 30 on opposite sides thereof. Each spur gear 60, 60' includes a plurality of spur gear teeth which intermesh in driven engagement with the inner gear teeth 39 of the sprocket gear 34, such that rotation of the sprocket gear 34 serves to rotate the spur gears 60, 60'. The spur gear teeth on gears 60, 60' are further disposed in intermeshing engagement with respective gear teeth on the second spur gears 56, 56' on the ends of the worm gear 50.

A helical gear 70 having a generally cylindrical configuration includes a central longitudinal cavity 72 extending therethrough having an inner surface structured and congruently configured for fitted receipt of an end of the pinion rod 120 therein. The inner surface of the longitudinal cavity 72 includes parallel grooves 74 which are specifically configured to receive corresponding ones of the elongate ridges 124 on the pinion rod 120 in snug fitted relation therein, preventing relative rotation between the helical gears 70 and pinion rod 120. The helical gear 70 further includes an outer gear surface 76 including a plurality of parallel elongate gear teeth 78 extending between opposite ends of the helical gear 70. The gear teeth 78 are slightly angled relative to a central longitudinal axis of the helical gear 70 and are specifically structured and disposed to receive a portion of the spiral gear ridge 54 of the worm gear in driven engagement between adjacent ones of the helical gear teeth 78. The angled orientation of the gear teeth 78 of the helical gear 70 with respect to the central longitudinal axis causes the helical gear to be rotated as the spiral gear ridge 54 of the worm gear 50 rides between the gear teeth 78. Driven rotation of the helical gear 70 in either of two opposite directions serves to rotate the pinion rod 120, as the pinion rod 120 is fixedly attached to the helical gear 70.

An end housing 80 is structured and disposed for fitted receipt within an opposite end of the track structure 110 and includes a hollow sleeve 82 specifically structured and disposed for rotatable support of an opposite end of the pinion rod 120 therein. The end housing 80 further includes horizontally disposed guide pulleys 84, 84' rotatably mounted on opposite, outboard sides of the end housing 80 so as to guide a pull cord (not shown for purposes of clarity) of the assembly therethrough in such a manner as to position the pull cord in generally coplanar, parallel relation with the pinion rod 120. In this manner, the line of force pulling each of the carrier assemblies 130 along the track structure 110 is generally coplanar with the central axis of the pinion rod 120, thereby eliminating a tendency of the carrier assemblies 130 to be tilted from a vertical position within the track structure 110 when being pulled therealong. The outboard positioning of pulleys 84, 84' also serves to maintain the pull cord in a substantially parallel orientation relative to the pinion rod 120, thereby eliminating an angled lead which would cause frictional engagement of the pull cord with the carrier assemblies near the end housing 80. The end housing end 80 further includes a flanged bottom 86 which fits within the track structure 110 and an end wall 88 structured and disposed to cover an otherwise open end of the track structure, thereby enhancing the overall appearance of the assembly.

The various gear ratios between the gears of the drive gear assembly 32 results in a reduction of rotational speed between the sprocket gear 34 and helical gear 70.

In a preferred embodiment, the reduction may be in the ratio of seven rotations of the sprocket gear 34 per one rotation of the helical gear 70. In this manner, a greater control of the rotation of the pinion rod 120 and resulting angular movement of the vanes is achieved.

While the present invention has been described in what is considered a preferred embodiment, it should be noted that departures may be made within the spirit and scope of the present invention as set forth in the claims and within the doctrine of equivalents.

Now that the invention has been described, what is claimed is:

1. For use in combination with a vertical blind assembly of the type including a horizontally disposed track assembly with an elongate pinion rod rotatably mounted therein and extending along a length thereof, a control unit structured and disposed for rotating said pinion rod;

said control unit comprising:

a control housing structured for mounting on said track assembly and including means to rotatably secure a first end of said pinion rod, an end housing structured for mounting on said track assembly and including means to rotatably secure a second opposite end of said pinion rod, said control housing and end housing structured and disposed for support and rotatable interconnection of said pinion rod within said track assembly, a drive gear assembly within said control housing structured for controlled, driven rotation of said pinion rod, said drive gear assembly comprising:

a sprocket gear movably driven by a pull chain selectively in either of two opposite directions and having opposite gear faces including an outer gear face adapted for driven engagement with said pull chain and an opposite inner gear face, a worm gear rotatably mounted within said control housing and including a spiral gear ridge about an outer surface thereof, a helical gear fixedly attached to said first end of said pinion rod and rotatable therewith, said helical gear being drivingly intermeshed with said worm gear and structured and disposed to be driven by said worm gear, said helical gear including a plurality of elongate gear teeth extending in substantially parallel relation to one another and structured for intermeshing driven engagement within a groove defined between said spiral gear ridge of said worm gear such that rotation of said worm gear by forced rotation of said helical gear is prevented, and intermediate gear means drivingly engaged between said worm gear and said inner gear face of said sprocket gear such that driven rotation of said sprocket gear by said pull chain serves to rotate said worm gear, said helical gear and the attached pinion rod.

2. Control unit as set forth in claim 1 wherein said control housing includes a pair of opposite pull cord channels structured and disposed for passage of a segment of a pull cord therethrough, each of said pull cord channels being positioned on opposite sides of said drive gear assembly and each including a horizontal section and a vertical section, said vertical section of each of said channels defining a vertically depending slot.

3. A control unit as set forth in claim 2 wherein said control housing includes an exposed end portion structured to extend outwardly from said track assembly when said control housing is mounted thereon, said exposed end portion including said vertically depending slots therein with an open bottom end of said vertically depending slots disposed adjacent to said track assembly to facilitate vertical passage of said pull cord therefrom.

4. A control unit as set forth in claim 3 wherein said opposite pull cord channels each include a pulley rotatably mounted at a junction between said horizontal section and said vertical section, said pulley being structured and disposed for guiding and movably supporting passage of said pull cord segment thereover, thereby accomodating for a change of directional movement of said pull cord between a horizontal direction and a vertical direction.

5. A control unit as set forth in claim 4 wherein said end housing includes a pair of outboard pulleys structured and disposed for passage of said pull cord thereabout to facilitate a 180 degree change of horizontal directional movement of said pull cord within said track assembly, said outboard pulleys being further structured and disposed to position said pull cord in coplanar and parallel relation to said pinion rod on opposite sides thereof.

6. A control unit as set forth in claim 4 wherein said control housing is structured for fitted receipt within an end of said track assembly such that said exposed end portion extends therefrom, exposing said open bottom end of said vertically depending slots to facilitate free, uninterrupted passage of said pull cord therefrom.

7. A control unit as set forth in claim 1 wherein said sprocket gear is rotatably mounted to said control housing about a central aperture having a central rotational axis extending therethrough.

8. A control unit as set forth in claim 7 wherein said outer gear face of said sprocket gear defines a bead chain sprocket structured for driven engagement with a section of a bead pull chain.

9. A control unit as set forth in claim 8 wherein said inner gear face includes a plurality of radial gear teeth radiating outwardly from said central aperture and being structured and disposed to drivingly engage said intermediate gear means upon driven rotation of said sprocket gear by said bead pull chain.

10. A control unit as set forth in claim 9 wherein said intermediate gear means includes a first pair of spur gears rotatably mounted within said control housing in driven engagement with said inner gear face of said sprocket gear.

11. A control unit as set forth in claim 10 wherein said intermediate gear means further includes a second pair of spur gears coaxially attached to said worm gear on opposite respective ends thereof and structured to rotate therewith about a common axis, said second pair of spur gears being drivingly intermeshed with said first pair of spur gears, whereupon driven rotation of said first pair of spur gears by said sprocket gear results in rotation of said second pair of spur gears, said worm gear and said helical gear respectively.

12. A control unit as set forth in claim 11 wherein said helical gear includes a rotational axis substantially perpendicular to said worm gear such that forced rotation of said helical gear or said attached pinion rod results in jamming of said elongate gear teeth of said helical gear against said spiral gear ridge on said worm gear, preventing rotation of said worm gear by said helical gear.

13. A control unit as set forth in claim 1 wherein said drive gear assembly is structured to rotate said pinion rod at a reduced rate relative to a rate of rotation of said sprocket gear.

14. A control unit as set forth in claim 13 wherein said drive gear assembly is structured to reduce the rate of rotation of said pinion rod at a ratio of one rotation of said pinion rod per every seven rotations of said sprocket gear.

15. For use in combination with a vertical blind assembly of the type including a horizontally disposed track assembly with an elongate pinion rod rotatably mounted therein and extending along a length thereof and being rotatably supported at a first end by an end cap housing, a control unit structured and disposed for rotating said pinion rod;

said control unit comprising:

a control housing structured for mounting on said track assembly opposite to said end cap housing and including means to rotatably secure an opposite second end of said pinion rod so as to provide support and rotatable interconnection of said pinion rod within said track assembly, a drive gear assembly mounted within said control housing and structured for controlled, driven rotation of said pinion rod, said drive gear assembly including a sprocket gear structured to be movably driven by a pull chain selectively in either of two opposite directions for drivingly operating said drive gear assembly, said drive gear assembly further including a plurality of intermeshing gears structured and intermeshed to prevent forced rotation of said pinion rod externally of said drive gear assembly, and said drive gear assembly further including reduction means structured to reduce a rate of rotation of said pinion rod relative to a rate of rotation of said sprocket gear upon driven movement thereof by said pull chain, thereby effectively enabling greater control of the degree and rate of rotation of said pinion rod.

* * * * *